US010617930B1

(12) United States Patent
Gause

(10) Patent No.: US 10,617,930 B1
(45) Date of Patent: Apr. 14, 2020

(54) SPORTS TRAINING APPARATUS TO ADDRESS FOCAL DYSTONIA

(71) Applicant: Brock Gause, San Jose, CA (US)

(72) Inventor: Brock Gause, San Jose, CA (US)

(73) Assignee: Brock Gause, San Jose, CA (US)

( * ) Notice: Subject to any disclaimer, the term of this patent is extended or adjusted under 35 U.S.C. 154(b) by 0 days.

(21) Appl. No.: 16/142,679

(22) Filed: Sep. 26, 2018

Related U.S. Application Data

(60) Provisional application No. 62/563,262, filed on Sep. 26, 2017.

(51) Int. Cl.
*A63B 69/36* (2006.01)

(52) U.S. Cl.
CPC ..... *A63B 69/3608* (2013.01)

(58) Field of Classification Search
CPC . A63B 69/3608; A63B 69/36; A63B 69/3623; A63B 69/0057; A63B 69/0059; A63B 69/3676; A63B 71/085
See application file for complete search history.

(56) References Cited

U.S. PATENT DOCUMENTS 2,461,826 A * 2/1949 Krautter ..... A63B 69/3608 124/44.6
3,505,995 A * 4/1970 Greenberg ..... A63B 71/085 128/862
3,860,246 A * 1/1975 Fish ..... A63B 69/3608 473/210
5,234,005 A * 8/1993 Kittelsen ..... A63B 71/085 128/859
5,293,880 A * 3/1994 Levitt ..... A63B 71/085 128/861
5,365,946 A * 11/1994 McMillan ..... A63B 71/085 128/861
5,485,357 A * 1/1996 Zolninger ..... A61F 4/00 362/103
5,651,680 A * 7/1997 Levy ..... A63B 69/0059 434/252
5,746,663 A * 5/1998 Calace ..... A63B 69/0002 473/211
6,332,846 B1 * 12/2001 Rennhack ..... A63B 69/3608 473/208
7,913,695 B1 * 3/2011 Moore ..... A63B 71/085 128/861

(Continued)

*Primary Examiner* — Raleigh W Chiu
(74) *Attorney, Agent, or Firm* — Brokaw Patent Law PC; Christopher J. Brokaw

(57) ABSTRACT

Sports training apparatus. The sports training apparatus is used to counter and overcome the condition known as focal dystonia, more commonly referred to as 'yips.' One end of the apparatus comprises a mouthpiece that is sized to accommodate insertion into the mouth of an athlete. The opposite end of the apparatus is shaped to be rotatably attached onto a container with a screw top, such as a water bottle or sports drink container. An athlete, such as a golfer, may practice a sporting technique, such as swinging a golf club, while focusing on keeping liquid within the container still, which minimizes stress and anxiety caused by performance expectations. The sports training apparatus may optionally contain a centerline pointer that acts as a visual aid to inform a user where the centerline of the athlete is currently positioned.

13 Claims, 6 Drawing Sheets

(56) References Cited

U.S. PATENT DOCUMENTS

| | | | | |
|---|---|---|---|---|
| 8,925,247 | B1 * | 1/2015 | Anastasi | A01G 27/005 47/79 |
| 2010/0123019 | A1 * | 5/2010 | Zehavi | A45F 3/18 239/33 |
| 2014/0083435 | A1 * | 3/2014 | Dorphley | A63B 71/085 128/861 |
| 2014/0345626 | A1 * | 11/2014 | Brett | A63B 71/085 128/861 |
| 2016/0263465 | A1 * | 9/2016 | Kennedy | A63B 71/085 |
| 2018/0071611 | A1 * | 3/2018 | Durbin | A47G 21/185 |
| 2018/0134455 | A1 * | 5/2018 | Czerwinski | B65D 25/48 |

* cited by examiner

SPORTS TRAINING APPARATUS TO ADDRESS FOCAL DYSTONIA

CLAIM OF PRIORITY

This application claims priority to U.S. provisional patent application No. 62/563,262, filed Sep. 26, 2017, entitled "Yip Kicker," invented by Brock Gause, the contents of which are hereby incorporated by reference for all purposes as if fully set forth herein.

FIELD OF THE INVENTION

Embodiments of the invention relate to a sports training apparatus.

BACKGROUND

Certain golfers may experience a phenomenon called 'yips.' The term 'yips' or 'the yips' refers to a condition known as focal dystonia. Athletes affected by the yips demonstrate a sudden, unexplained loss of previous skill. The condition may occur suddenly and without apparent explanation, usually in mature athletes with years of experience. There is no known treatment or therapy in the current state of the art. Athletes affected by the yips sometimes recover their ability, although a change in technique may be required. The yips can force athletes to abandon their sport at the highest level.

BRIEF DESCRIPTION OF THE DRAWINGS

Embodiments of the invention are illustrated by way of example, and not by way of limitation, in the figures of the accompanying drawings and in which like reference numerals refer to similar elements and in which.

DETAILED DESCRIPTION OF EMBODIMENTS

A sports training apparatus, and a method of use thereof, is presented herein. In the following description, for the purposes of explanation, numerous specific details are set forth in order to provide a thorough understanding of the embodiments of the invention described herein. It will be apparent, however, that the embodiments of the invention described herein may be practiced without these specific details. In other instances, well-known structures and devices are shown in block diagram form or discussed at a high level in order to avoid unnecessarily obscuring teachings of embodiments of the invention.

Embodiments of the invention relate to a sports training apparatus which may be used in a variety of different athletics. As certain embodiments of the invention have particular utility in the sport of golf, many of the examples discussed herein will be discussed with reference to concrete examples involving golf; however, embodiments of the invention are by no means limited to golf.

The sports training apparatus is used to counter and overcome the condition known as focal dystonia, more commonly referred to as 'yips.' For this reason, examples of a sports training apparatus of an embodiment may be referred to as a 'Yip Kicker.' The Yip Kicker may help a golfer maintain a "quiet" golf stance and promote a visual and physiological focus when performing a sporting technique, such as hitting a golf ball.

Many golfers are plagued by the yips. The yips often manifest during the performance of partial (i.e., less than a full swing) movement shots, such as putting or chipping/pitching. In golf, yips is generally characterized by excessive nervousness resulting in the over control of a golf swing to the point that the golfer cannot smoothly perform the golf shot. Yips can cause different manifestations of body movement in golfers.

Figure 1:
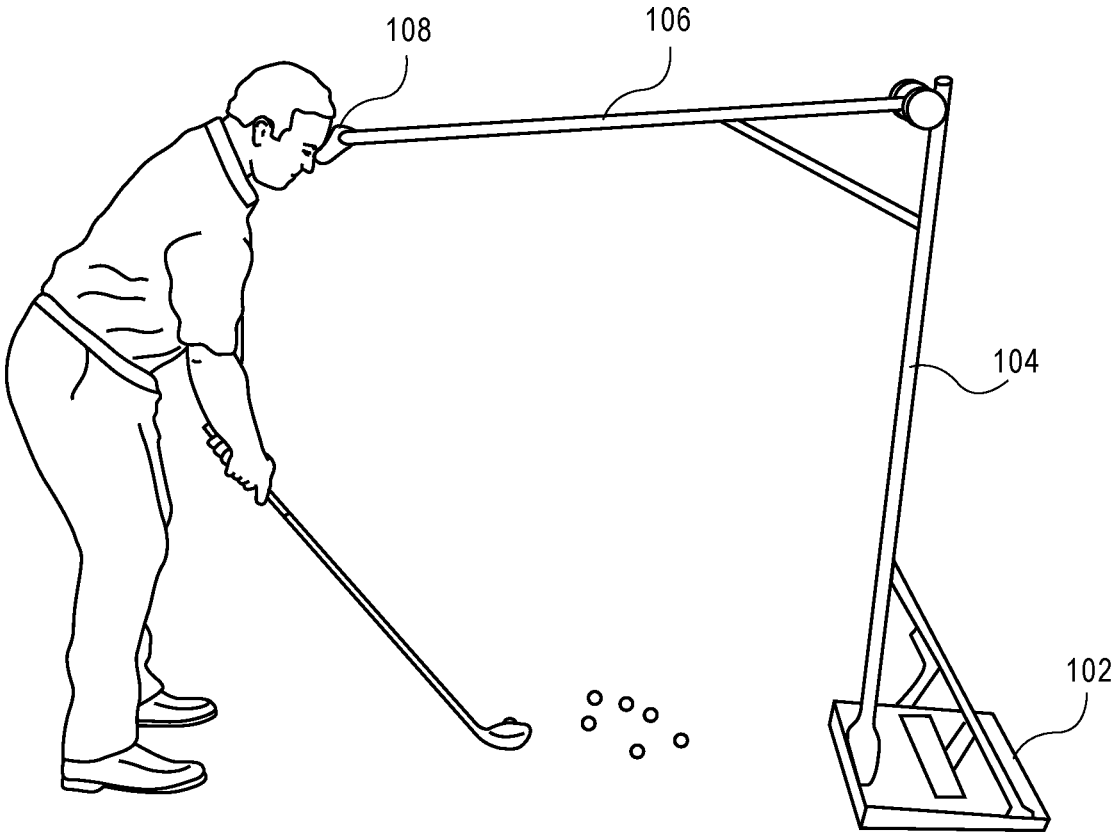
FIG. 1 (PRIOR ART)
FIG. 1 is an illustration of a golfer using a touch probe according to the prior art.

The training aids currently employed by the prior art differ significantly to the embodiments discussed herein. To illustrate, consider FIG. 1, which is an illustration of a golfer using a touch probe according to the prior art. As shown in FIG. 1, the touch probe comprises a heavy base 102 that anchors the touch probe. A vertical pole 104 is connected to base 102. The vertical pole 104 extends in a vertical direction about the height of an adult human. A horizontal pole 106 is connected to horizontal pole 104. A head rest 108 is disposed at the end of horizontal pole 106. As shown in FIG. 1, the golfer attempts to rest his or her head upon head rest 108 to aid the golfer in maintaining his or her head steady during the swing of the golf club. However, as can be readily appreciated, the touch probe shown in FIG. 1 is a bulky, non-portable, expensive device. One can readily appreciate that the touch probe shown in FIG. 1 is that it is too heavy and cumbersome to regularly transport onto a golf course.

Another disadvantage of the touch probe of FIG. 1 is that while head rest 108 may be used as a stabilizer upon which the golfer's head may rest to help minimize large head movements, head rest 108 cannot provide feedback to the golfer for smaller accelerations and movements of the head and shoulders. Thus, while the touch probe of FIG. 1 may help reduce large movements in the head, the touch probe does not address the yips in any perceivable manner. Further, as soon as the golfer detaches from head rest 108, there is no more sensor input provided to the golfer.

Figure 2:
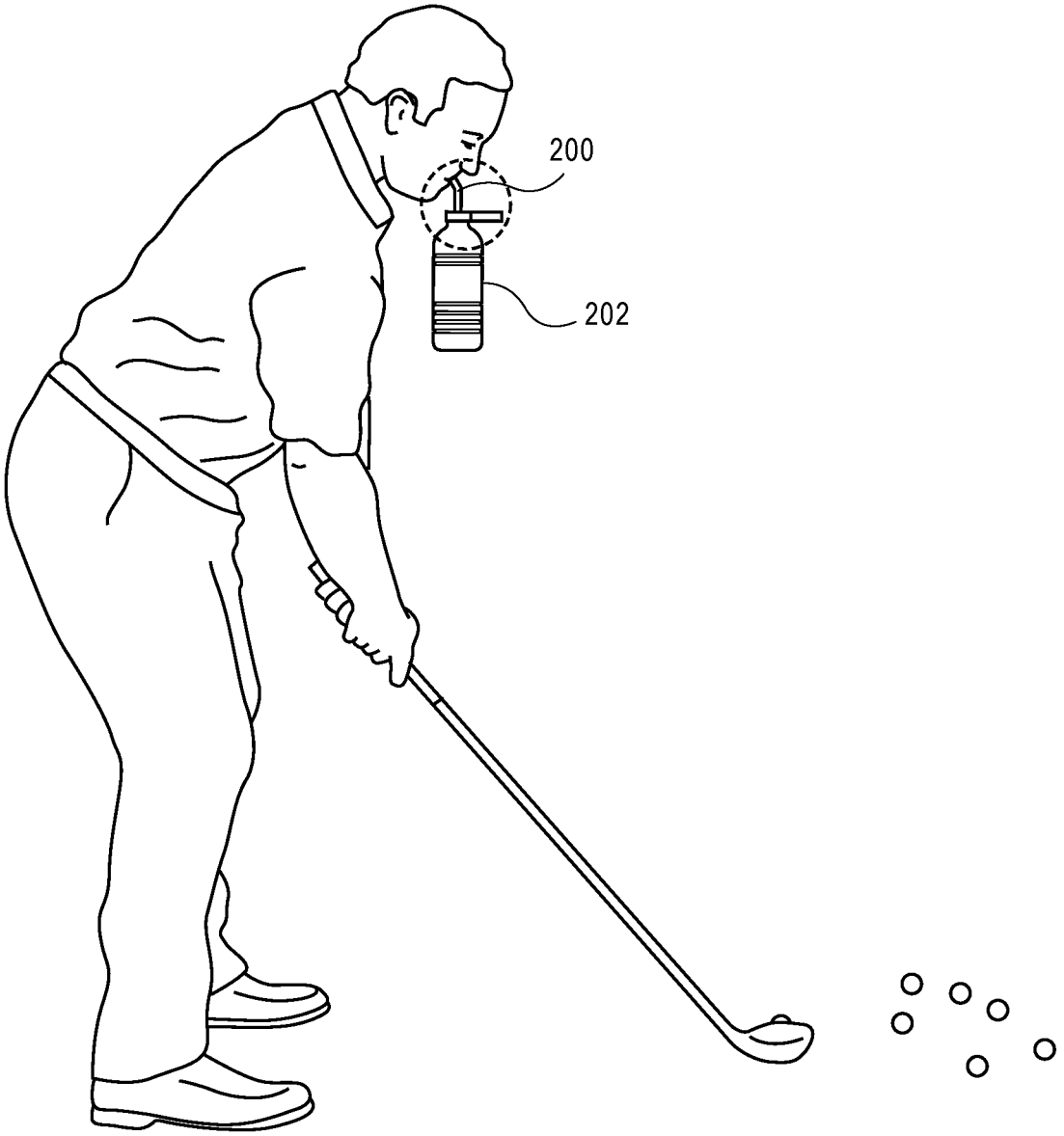
FIG. 2 is an illustration of a golfer using an apparatus according to an embodiment of the invention.

FIG. 2 is an illustration of a golfer using an apparatus according to an embodiment of the invention. As shall be explained in detail below, embodiments of the invention offer many advantages over the prior art. FIG. 2 illustrates a golfer using a sports training apparatus 200 of an embodiment, which is also referred to herein as Yip Kicker 200. Yip Kicker 200 may be constructed as a small injection molded fixture that may be screwed onto a drinking vessel 202, such as without limitation a water bottle or a sports drink bottle. Another method that may be used to attach Yip Kicker 200 to drinking vessel 202 include snapping onto, grasping, or enclosing a neck or bottle cap of drinking vessel 202. FIG.

Figure 8:
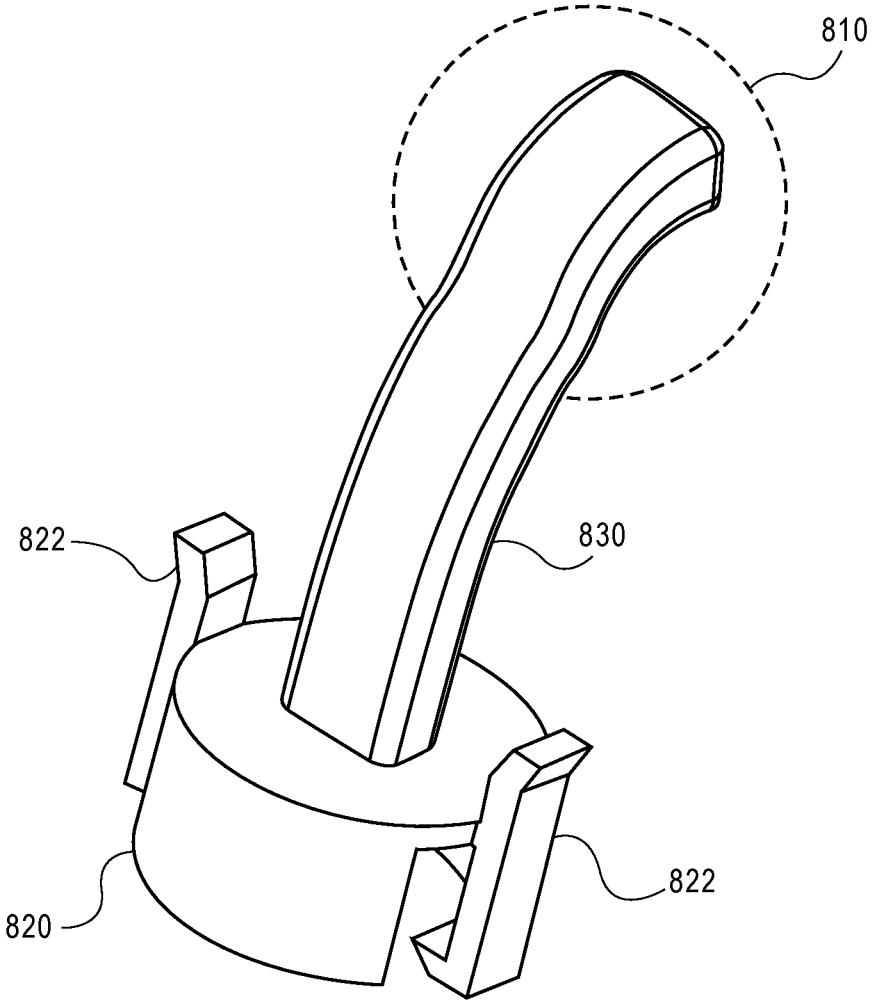
FIG. 8 is an illustration of a sports training apparatus having a connector that is shaped to be inserted into a mouth of a drinking vessel and coupled thereto via a self-hooking component according to one embodiment of the invention.

7 is an illustration of a sports training apparatus having a mouthpiece 710, a stem 730, and a connector 720 that is shaped to be snapped onto, grasping, or enclosing a neck or bottle cap of a drinking vessel according to one embodiment of the invention. Other methods of attachment may be used, such as without limitation such as penetrating into a lid, enclosure, bottle cap, or the link of drinking vessel 202 and self-hooking or affixing into position. FIG. 8 is an illustration of a sports training apparatus having a mouthpiece 810, a stem 830, and a connector 820 that is shaped to be inserted into a mouth of a drinking vessel and coupled thereto via a self-hooking component 822 according to one embodiment of the invention. Drinking vessel 202 may be partially filled with water or some other beverage. The athlete using Yip Kicker 200 attempts to performs a sporting technique, such as swinging a golf club, while having Yip Kicker 200 positioned in his or her mouth. During the performance of the sporting technique (e.g., swinging the golf club), the athlete attempts to keep Yip Kicker 200 as still as possible and devoid of movement. The athlete can easily gauge his or her success by viewing the movement of the beverage within drinking vessel 202 during and after the performance of the sporting technique. Note that the operator of Yip Kicker 200 will be staring directly at, or in the direction of, the partially filled drinking vessel 202, and so the beverage within drinking vessel 202 will be readily visible and a primary center of focus.

Yip Kicker 200 is designed to be inserted into the mouth during training. While this may appear counterintuitive to current and known approaches for sporting training equipment, it is based on sound principles. The mouth is aligned with the centerline of the body and spine. As Yip Kicker 200 hangs directly off this centerline, a golfer may use Yip Kicker 200 as an aid in finding the tangent point of a golfer's swing. The golfer may use Yip Kicker 200 to locate the center of the swing and then swing without moving the beverage within drinking vessel 202 attached to Yip Kicker 200 as much as possible. Because of this shift in focus, the golfer will be focused on the sensory input produced by Yip Kicker 200 rather than the act of hitting the ball.

A person's mouth and teeth are both very sensitive to stress. The weight of the beverage within drinking vessel 202 creates a baseline mean stress on the mouth and teeth. Motions due to accelerations caused by body movements will be directly transmitted into the golfer's sensory system vis-à-vis Yip Kicker 200. Such sensory "touch and feel" input will reflect accelerations of the body in any axis. Consequently, Yip Kicker 200 provides sensory input with respect to monitoring head and body movement caused by any type of inadvertent body movements.

Visual and sensory inputs also help train the user to place their mental focus on a specific target objective, namely maintaining the beverage within drinking vessel 202 to be as still as possible, i.e., producing no wave action. Redirecting the user's focus from their social and physical situation to keeping Yip Kicker 200 stationary can quickly eliminate the mental stress of the yips. Use of Yip Kicker 200 in a training situation transfers to the golf course as the golfer can easily visually the visual input of the beverage within drinking vessel 202 as well as the feel of Yip Kicker 200 through their teeth. Water and other liquids are an ultimate indicator of movement and change of position but no one has previously used water or liquids to measure dynamic motion in the manner described herein. Yip Kicker 200 redirects the golfer's focus from the golf ball to sporting technique and, more particularly, maintaining a still posture, which runs directly contrary to conventional thinking in golf (recall that a common training mantra is to "keep your eye on the ball").

Figure 3:
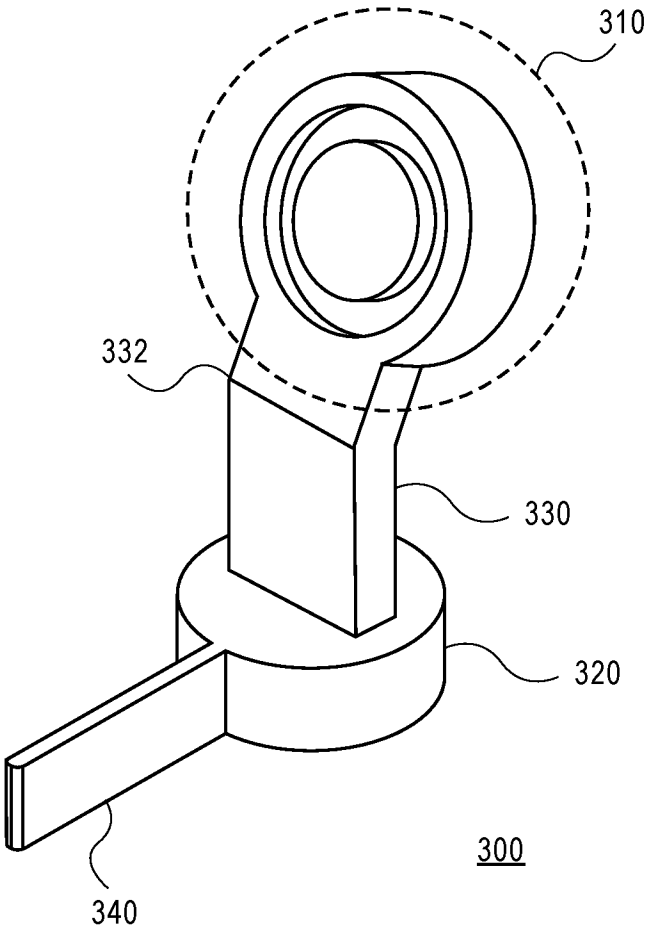
FIG. 3 is an illustration of a sports training apparatus according to one embodiment of the invention.

Physical features of Yip Kicker 300 according to an embodiment of the invention are illustrated in FIG. 3. Yip Kicker 300 comprises a mouthpiece 310, a connector 320, and a stem 330. Mouthpiece 310 is inserted into the mouth of the athlete using Yip Kicker 300. As such, mouthpiece 310 should be sized to accommodate insertion into a mouth.

Mouthpiece 310 may be embodied by a variety of different shapes across embodiments of the invention. Mouthpiece 310 is designed to be comfortable fit and be held in place by the teeth within a person's mouth, and so comfort and fit may dictate a number of different sizes and shapes. To illustrate this point, consider FIG. 4, which is an illustration of Yip Kicker 400 according to one embodiment of the invention. Note that mouthpiece 312 shown in FIG. 4 has a different shape than that of mouthpiece 310 shown in FIG. 3. Mouthpiece 312 has a form of a bite guard or a night guard, whereas mouthpiece 310 has a more circular shape. Accordingly, the mouthpiece may be shaped differently across embodiments of the invention, as people may have differing opinions as to what shape is more comfortable in their own mouth. Embodiments of the invention are not limited to any particular shape of mouthpiece, as other shapes may be used as well as any methods of holding Yip Kicker in the mouth (such as the tongue, the palate, the lips, and the like).

Embodiments of the invention may cover the mouthpiece, either entirely or partially, of a Yip Kicker in an elastomer to make the mouthpiece more comfortable to the user. Other materials may be used instead of or in addition to the elastomer.

Returning again to FIG. 3, connector 340 is positioned on the opposite end of stem 330 than mouthpiece 310. Connector 340 is shaped to be rotatably attached onto drinking vessel 202, e.g., connector 340 may be attached to drinking vessel 202 by screwing on Yip Kicker 300 at connector 340.

Drinking vessel 202 may correspond to any commonly available plastic bottle, such as a water bottle, commercial sports drink, carbonated beverage in a plastic bottle, and the like. The beverage within drinking vessel 202 may be any beverage, but for visibility purposes it is anticipated that water or other clear or lightly covered beverages are particularly well suited. Note that connector 340 may be attachable to a wide variety of containers, so that a wide variety of containers that containing a wide variety of liquids may be employed. The amount of beverage within drinking vessel 202 may be adjusted based on user preference; thus, the weight of the beverage within drinking vessel 202 is adjustable.

Yip Kicker 300 may be constructed as a small injection molded apparatus. Advantageously, Yip Kicker 300 may be produced in an inexpensive manner due to the efficiency of parts and construction. Yip Kicker 300 may also be made of metal, wood, ceramic, glass, various other types of plastic, and the like.

Figure 4:
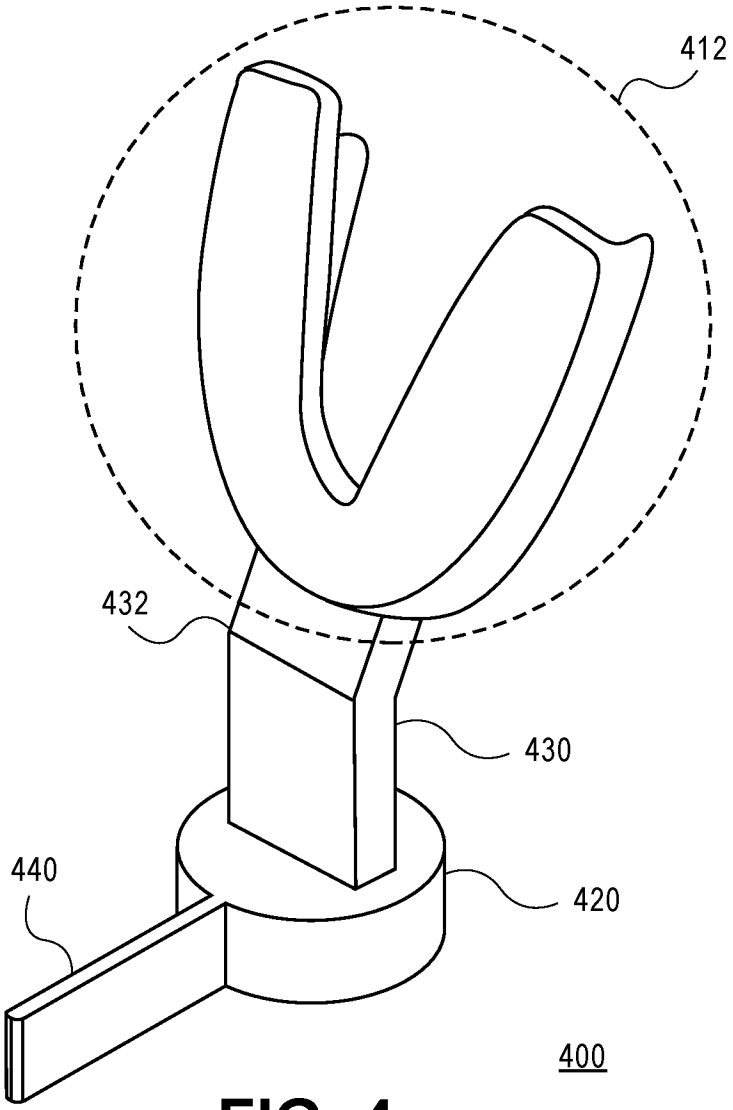
FIG. 4 is an illustration of a sports training apparatus according to another embodiment of the invention.

FIGS. 3 and 4 each depict centerline pointer 340. Centerline pointer 340 may be, but need not be, capable of being adjusted, around the axis of rotation of connector 430, to allow for precise location for the strong eye typically used in locating a point on the ground or golf ball. Centerline pointer 340 may serve as an indicator for the position of a golf ball relative to the bottom point (tangent) of the golfer's swing when contacting the golf ball. Golf, depending on the club selection, requires the golf ball to the placed forward or backward of the bottom point (tangent) of the golfer's swing. This, centerline pointer 340 may aid the golfer in precisely locating this position.

FIGS. 3 and 4 each depict stem 330 possessing an angle 332. Angle 332 may be, but need not be, adjustable to accommodate each golfer's head angle relatively to the direction in which the Yip Kicker is hanging from the mouth of the athlete due to the force of earth's gravity. Angle 332 is depicted in FIGS. 3 and 4 as being a sharp angle, but in other embodiments, angle 332 may be a curve rather than a sharp angle.

Figure 6:
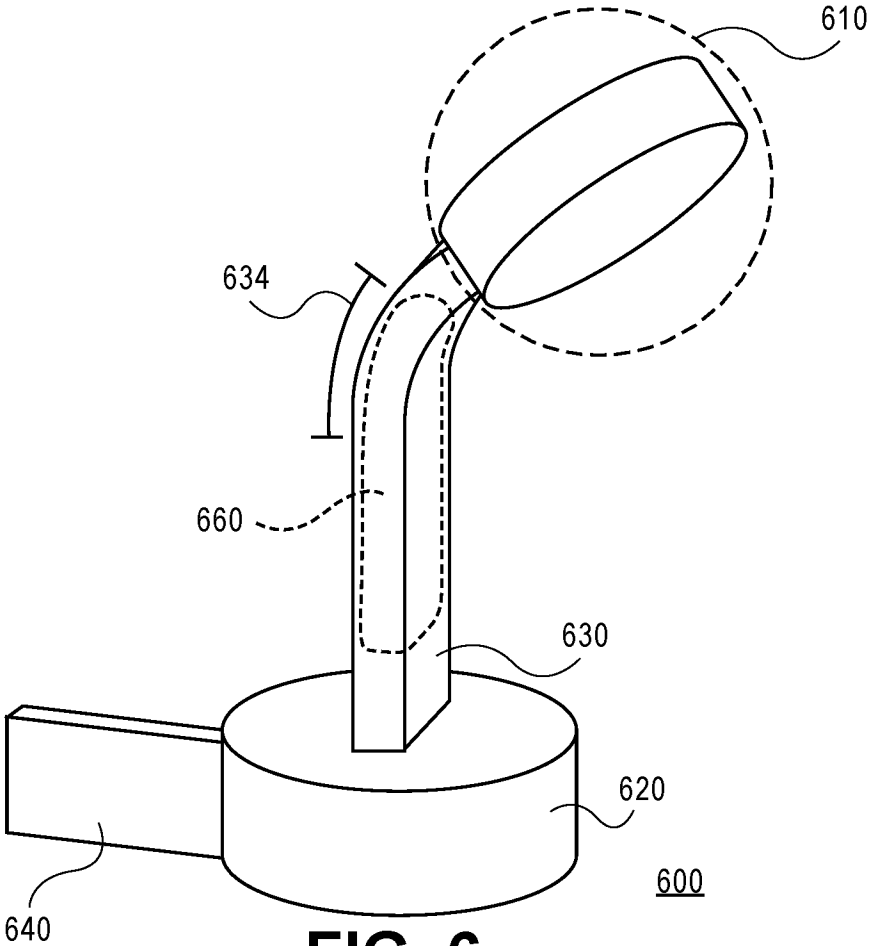
FIG. 6 is an illustration of a sports training apparatus having am interior cavity according to one embodiment of the invention.
Figure 5:
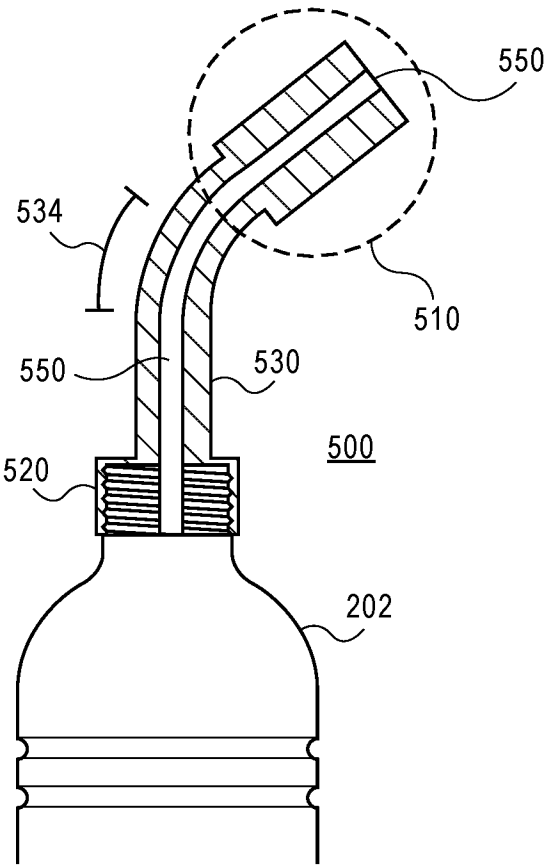
FIG. 5 is an illustration of a sports training apparatus having a hollow cavity extending therethrough according to one embodiment of the invention.
Figure 7:
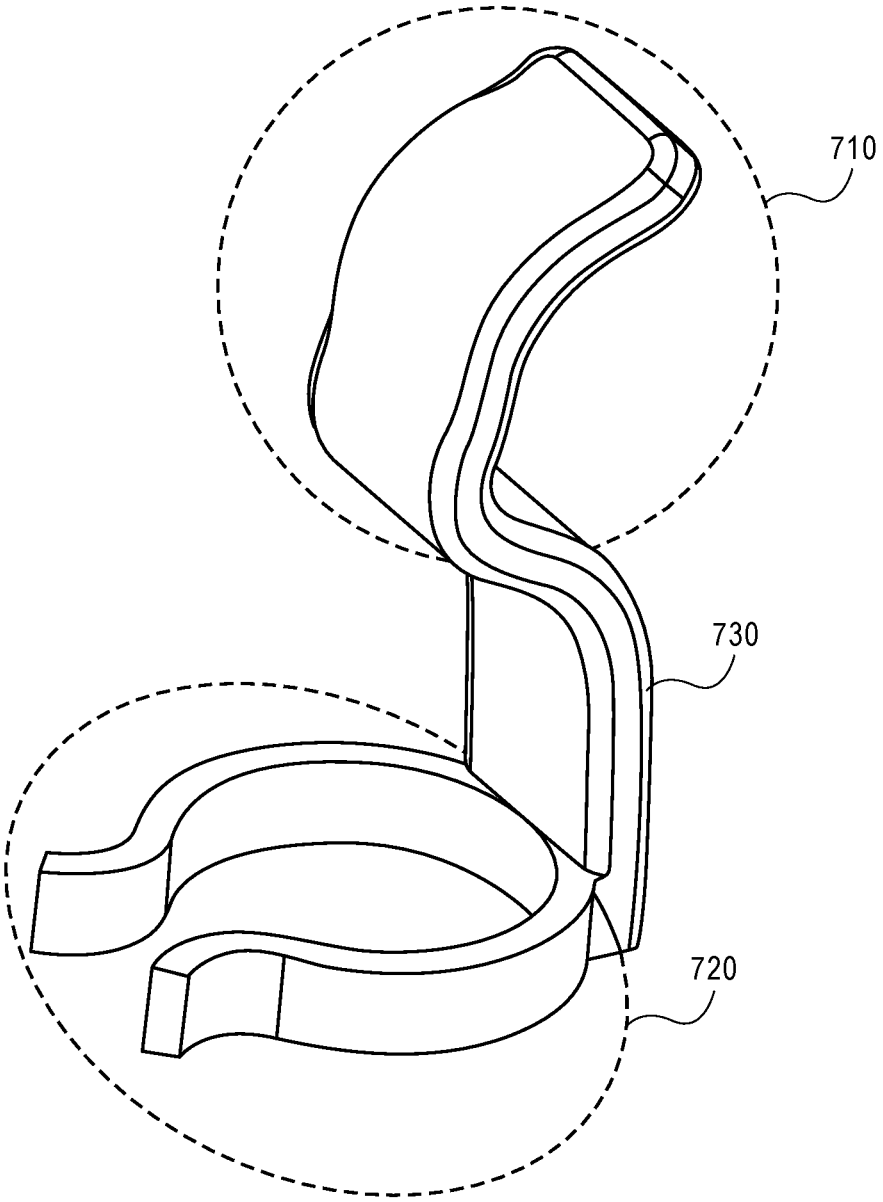
FIG. 7 is an illustration of a sports training apparatus having a connector that is shaped to be snapped onto, grasping, or enclosing a neck or bottle cap of a drinking vessel according to one embodiment of the invention.

For example, FIGS. 5 and 6 each depict a Yip Kicker (Yip Kicker 500 and 600 respectively) that possesses a curved stem rather than a sharp angle in accordance with an embodiment of the invention. Yip Kicker 500 depicted in FIG. 5 comprises a mouthpiece 510, a connector 520, and a stem 530 with a curve 534. FIG. 5 depicts Yip Kicker 500 rotably attached to bottle 202 vis-à-vis connector 520. Stem 530 comprises a curve 534 relative to a transverse plane between mouthpiece 550 and connector 520 as shown in FIG. 5.

Yip Kicker 500, shown in FIG. 5, also comprises hollow cavity 550 within its interior that extends from mouthpiece 550 to connector 520. The hollow cavity 550 may be used as a straw such that when a user of Yip Kicker has mouthpiece 550 in his mouth, the user may suck any beverage contained within drinking vessel 202 through hollow cavity 550 into the mouth of the user for consumption.

Another embodiment of the invention is shown in FIG. 6, which depicts Yip Kicker 600 that comprises a mouthpiece 610, a connector 620, a stem 630, and centerline pointer 640. Yip Kicker 600, shown in FIG. 6, also comprises interior cavity 660. Interior cavity 660 is disposed entirely within the interior of stem 630. Interior cavity 660 may be filled within a substance, such as gel or foam, which permits the magnitude curve 634 to be more easily adjustable. In other embodiments not depicted in FIG. 6, rather than possessing interior cavity 660, stem 630 may be composed using an elastomer that is disposed around a foam layer to allow for a certain amount of flexibility or malleability in the structure.

In addition, embodiments of the invention may deploy a digital accelerometer on the mouthpiece which provides movement data to a software application that is designed to model the golfer's movements with respect to a desired set of movements. In addition, such a software application may also receive movement data from additional accelerometers, such as one affixed to a golfer's belt and/or wrist, to supplement the data analyzed by the software application.

A sports training apparatus of an embodiment promotes training of muscle motions to minimize unwanted head and/or body movement. The sports training apparatus of an embodiment may be used for a variety of sports that require a surrogate point of focus, such as, for example, croquet and darts.

In the foregoing specification, embodiments of the invention have been described with reference to numerous specific details that may vary from implementation to implementation. Thus, the sole and exclusive indicator of what is the invention, and what is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. Sports training apparatus, comprising:

a mouthpiece sized to accommodate insertion into a mouth;

a connector, on an opposite end of said apparatus from said mouthpiece, which is shaped to be rotatably attached onto a rigid drinking vessel; and a stem disposed between said mouthpiece and said connector, wherein said sports training apparatus further comprises a centerline pointer that projects from said connector substantially perpendicular from an axis of rotation by which said connector is shaped to be rotatably attached to said drinking vessel, wherein a position of said centerline pointer around said axis of rotation is adjustable.

2. The apparatus of claim 1, wherein said stem possesses an angle or a curve relative to a transverse plane between said mouthpiece and said connector.

3. The apparatus of claim 2, wherein a magnitude of said angle or said curve is adjustable.

4. The apparatus of claim 1, wherein said sports training apparatus comprises a hollow cavity within an interior of said sports training apparatus that extends from said mouthpiece to said connector.

5. The apparatus of claim 1, wherein said stem of said sports training apparatus comprises a gel filled cavity.

6. The apparatus of claim 1, wherein said stem of said sports training apparatus comprises a foam filled cavity.

7. The apparatus of claim 1, wherein said sports training apparatus is a single injection molded plastic object that comprises said mouthpiece, said connector, and said stem.

8. The apparatus of claim 1, wherein said mouthpiece comprises or corresponds to a mouthguard.

9. The apparatus of claim 1, wherein said connector is shaped to be rotatably attached onto said drinking vessel using a rigid screw thread cap which seats against said drinking vessel.

10. The apparatus of claim 1, wherein said connector is shaped to be snapped onto, grasping, or enclosing a neck or bottle cap of said drinking vessel.

11. The apparatus of claim 1, wherein said connector is shaped to be inserted into a mouth of said drinking vessel and coupled thereto via a self-hooking component.

12. Sports training apparatus, comprising:

a mouthpiece sized to accommodate insertion into a mouth;

a connector, on an opposite end of said apparatus from said mouthpiece, which is shaped to be attached onto a rigid drinking vessel; and a stem disposed between said mouthpiece and said connector, wherein said stem of said sports training apparatus further comprises an accelerometer or gyroscope.

13. The apparatus of claim 12, wherein said stem of said sports training apparatus further comprises a wireless transceiver which transmits data collected from said accelerometer or said gyroscope over a wireless network.

* * * * *